United States Patent [19]

Larson

[11] Patent Number: 4,603,328

[45] Date of Patent: Jul. 29, 1986

[54] SKI TRACKING ALARM

[76] Inventor: Donald Larson, 3435 Adams Ave., San Diego, Calif. 92116

[21] Appl. No.: 640,830

[22] Filed: Aug. 15, 1984

[51] Int. Cl.[4] ..... G08B 21/00; A63C 11/00

[52] U.S. Cl. ..... 340/666; 280/612

[58] Field of Search ..... 340/665, 666, 571; 280/611, 809, 612, 816

[56] References Cited

U.S. PATENT DOCUMENTS

| | | | |
|---|---|---|---|
| 4,140,331 | 2/1979 | Salomon | 280/612 |
| 4,279,433 | 7/1981 | Petaja | 340/571 |

FOREIGN PATENT DOCUMENTS

| | | | |
|---|---|---|---|
| 0047629 | 3/1982 | European Pat. Off. | 280/611 |
| 2700238 | 7/1978 | Fed. Rep. of Germany | 280/816 |
| 2736600 | 2/1979 | Fed. Rep. of Germany | 280/611 |
| 2926385 | 1/1980 | Fed. Rep. of Germany | 280/809 |

*Primary Examiner*—James L. Rowland
*Assistant Examiner*—Anne Marie F. Capati
*Attorney, Agent, or Firm*—Charmasson & Holz

[57] ABSTRACT

A ski tracking alarm comprises a self-contained unit for mounting on a ski between the toe and heel bindings so that it is located beneath the ski boot during skiing. The unit comprises an audible alarm device and a triggering device for actuating the alarm to produce an audible alarm signal on separation of the ski boot from the ski. The triggering device includes a spring-loaded actuator which is held in an inoperative position by pressure of the ski boot acting on the unit, but springs up into an operative position when the ski boot is separated from the ski.

7 Claims, 9 Drawing Figures

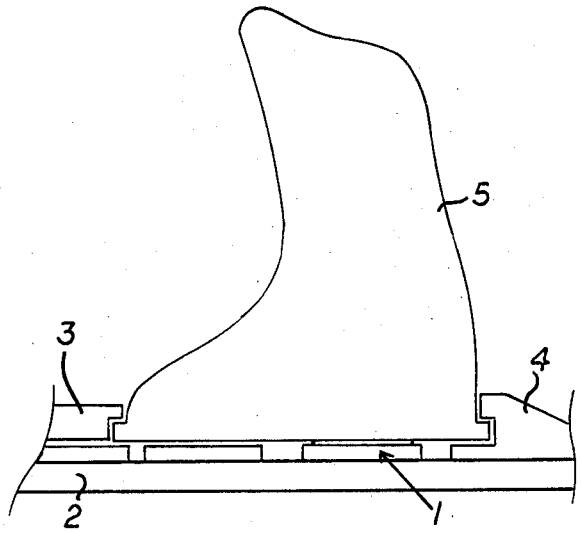
FIG. 1
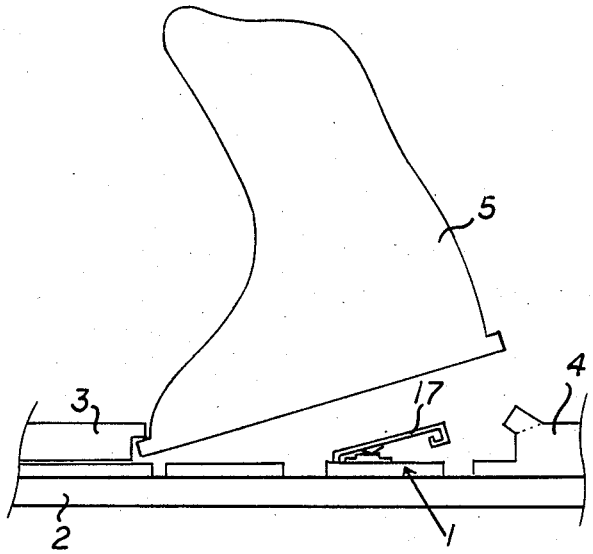
FIG. 2
FIG. 8
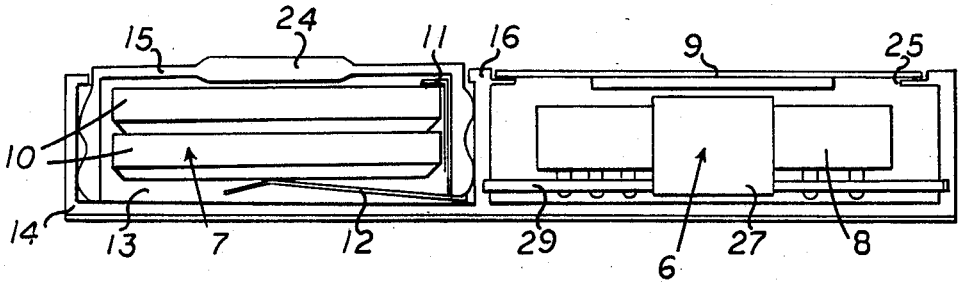

SKI TRACKING ALARM

BACKGROUND OF THE INVENTION

The present invention relates to an alarm device for installation on skis which is actuated when a ski beomes separated from the skier, for example following a fall.

When a skier falls, one or both skis will become separated from the skier and normally slide some distance before they are stopped by the ski brakes. Because of their slim, streamlined shape they can easily become buried in the snow, particularly if it is powder snow or deep snow. Thus the skier my have some difficulty in locating the skis after a fall.

Some devices have been proposed to make skis easier to locate after a fall. In U.S. Pat. No. 4,279,433 of Petaja a strobe light beacon is activated when a ski is separated from the skier. The actuating or triggering device is mounted either in the ski binding or is incorporated into the ski boot. The beacon is mounted separately on the ski. It is not certain that a strobe light would be readily visible to the skier, particularly if the ski was completely buried or if the weather conditions or lighting were bad. The ski itself, and possibly the ski boot as well, have to be modified to incorporate the device, making it relatively complex and expensive.

In U.S. Pat. No. 4,140,331 of Salomon a beacon mounted in the ski binding is actuated by the closing of a spring loaded contact when the ski boot is separated from the ski. Again the ski binding itself has to be modified to incorporate the beacon device.

Another problem with both of these devices is that they must be switched off when the skis are not in use. If the skier forgets to switch on the device when he subsequently uses the skis, it will be useless.

SUMMARY OF THE INVENTION

It is an object of the present invention to provide a practical ski tracking alarm which is self-contained and which can be simply mounted on any ski without any modification of the ski, binding, or ski boot.

According to the present invention a ski tracking alarm is provided which comprises a self-contained unit for mounting on a ski between the toe pad and the heel pad/ski brake device. The unit includes an audio signalling device and a triggering device for operating the signalling device on separation of a ski boot from the ski.

The triggering device includes spring loaded contacts which are normally held open by the pressure of a ski boot on the unit, but which are spring loaded into a closed position to actuate the audible alarm when the boot is removed or separated from the ski.

The unit can be mounted on any existing ski by simply attaching it to the face of the ski in an appropriate position with an adhesive. Thus the skier can simply purchase two such units and attach them to his own skis, without having to buy specially modified ski bindings or skis.

The audio signal is loud enough to be heard when the ski is buried under the snow.

In a preferred embodiment a latching device is provided for holding the alarm off while the ski is not in use. The latching device is arranged to be automatically released when a boot is mounted on the ski, so that the skier does not have to remember to re-actuate the alarm every time he uses the skis. After skiing the device can be re-latched to switch the alarm off.

The self-contained unit is simple, compact and can be readily mounted by a skier on his skis without any modification of the ski bindings.

BRIEF DESCRIPTION OF THE DRAWINGS

FIG. 1 is a diagrammatic side view showing a ski alarm according to a preferred embodiment of the invention mounted on a ski below a ski boot;

FIG. 2 is a view similar to FIG. 1 showing the alarm actuated as the boot is separated from the ski;

FIG. 6 is a partial cross section on the lines 6—6 of FIG. 3, showing the alarm ON;

FIG. 8 is a sectional view on the lines 8—8 of FIG. 3; and

DESCRIPTION OF THE PREFERRED EMBODIMENT

Figure 3:
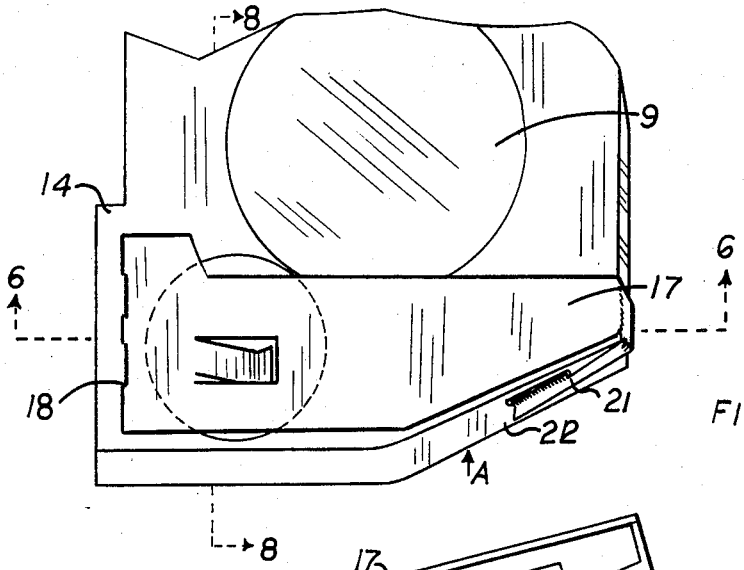
FIG. 3 is a top plan view of the ski alarm.

A ski tracking alarm according to a preferred embodiment of the invention is shown in the drawings.

As shown in FIGS. 1 and 2, the alarm is a self-contained unit 1 which can be secured with a suitable adhesive to a ski 2 between the toe pad 3 and heel pad/ski brake 4 of the ski. The unit 1 is thin enough such that a ski boot 5 can be mounted on the ski 2 as shown in FIG. 1 with the unit 1 underneath the boot. Thus the unit 1 does not interfere with the proper engagement of the boot in the heel binding 4.

As shown in FIG. 8, the unit includes an audio signalling device 6 and a triggering device 7 for operating the signalling device to produce an audible alarm signal. The audio signalling device basically comprises an electronic circuit 8, shown in FIG. 9, for producing sound via piezoelectric speaker or transducer disc 9 when actuated by the triggering device 7.

Figure 6:
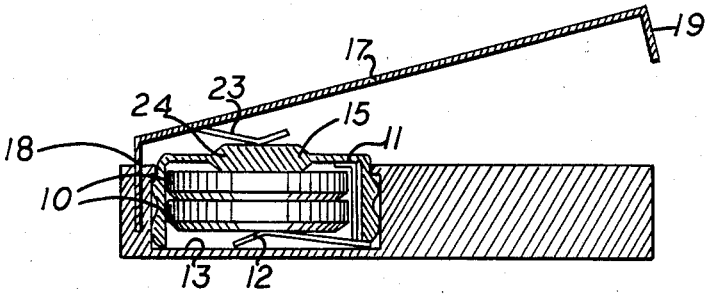
Figure 7:
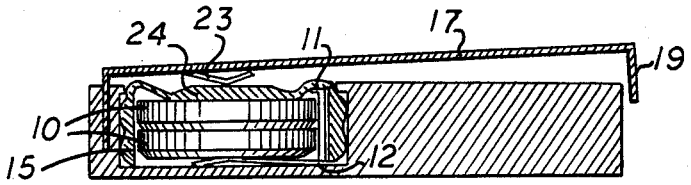
FIG. 7 is a view similr to FIG. 6 showing the alarm OFF.

The triggering device 7 shown in FIGS. 6 to 8 basically comprises a pair of coil cell batteries 10 mounted between a fixed contact 11 and a movable actuator contact 12. Actuator contact 12 is spring loaded towards the raised, operative position shown in FIG. 6 where it pushes the batteries 10 upwards into contact with the fixed contact 11. When the batteries 10 are pushed down by the pressure of a ski boot mounted above the unit, the spring-loaded contact 12 is compressed or flattened as shown in FIGS. 7 and 8, and the fixed contact 11 will be spaced above the batteries 10 to disconnect the batteries from the electronic circuit 8.

The triggering device 7 is mounted in recess 13 in a waterproof housing 14 in which the electronic circuit 8 is mounted. The batteries and contacts are sealed within a boot 15 which is an interference fit in the recess 13 and is retained in the recess by inturned lip 16. The boot is suitable of silicone rubber or other flexible material for sealing the batteries and contacts against ingress of water.

A spring latching plate 17 is pivotally mounted at one edge 18 in the housing adjacent the recess 13 and extends over the triggering device to the opposite edge of the housing 14 as shown in FIG. 3. The free end of the plate 17 has an inturned lip 19 which bends down over the edge of the housing. A spring tab 20 projects rearwardly and downwardly from the lip 19 as shown in FIGS. 3 to 6 for latching engagement in an angled recess 21 provided in inclined face 22 of the housing. A bent spring tongue 23 projects from the undersurface of the plate 17 to bear against a thickened central portion 14 of the boot 15.

Figure 5:
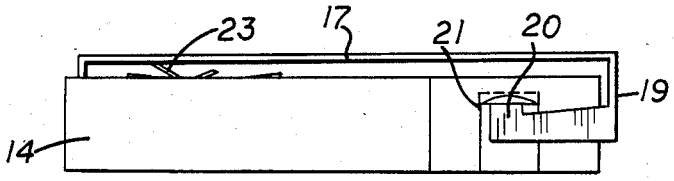
FIG. 5 is a side view similar to FIG. 4 showing the alarm latched OFF.

The latching plate 17 is arranged to hold the triggering device off when the ski on which the alarm is mounted is not in use. When the latching plate 17 is pushed down, the tongue 23 bears against the central portion 24 of the rubber boot 16 and thus pushes the batteries 10 and the contact 12 downwards and away from the contact 11, as shown in FIG. 7. In this position the tab 20 may be pressed into the housing recess 21 to latch or lock the alarm off, as shown in FIG. 5. Once the tab 20 is latched, the upward spring force of the plate 17 drives the tab 20 deeper into the angled recess, where it will be held until released.

The alarm will normally be latched off in this manner when the unit is mounted on a ski. When a skier subsequently inserts his ski boot into the toe and heel bindings, the ski boot will press down on the latch plate 17, allowing the spring tab 20 to spring out of the recess 21 and to unlatch the unit for operation. The pressure of the ski boot acting on the spring plate 17 during ski-ing will act to hold the alarm off as shown in FIG. 7.

Figure 4:
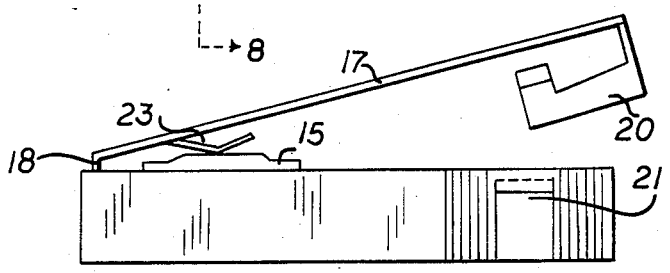
FIG. 4 is a side view of the alarm in the direction A of FIG. 3, shown in its ON position.

If the skier should fall, causing the ski to become separated from the boot, the latch plate 17 will spring upwards as shown in FIGS. 2, 4 and 6. The spring contact 12 will then be free to spring upwards until the batteries 10 contact the inturned lip of the stationary contact 11, as shown in FIG. 6. The alarm circuit will then be actuated and an audible signal will be emitted from the speaker 9, llowing the skier to locate the ski.

Figure 9:
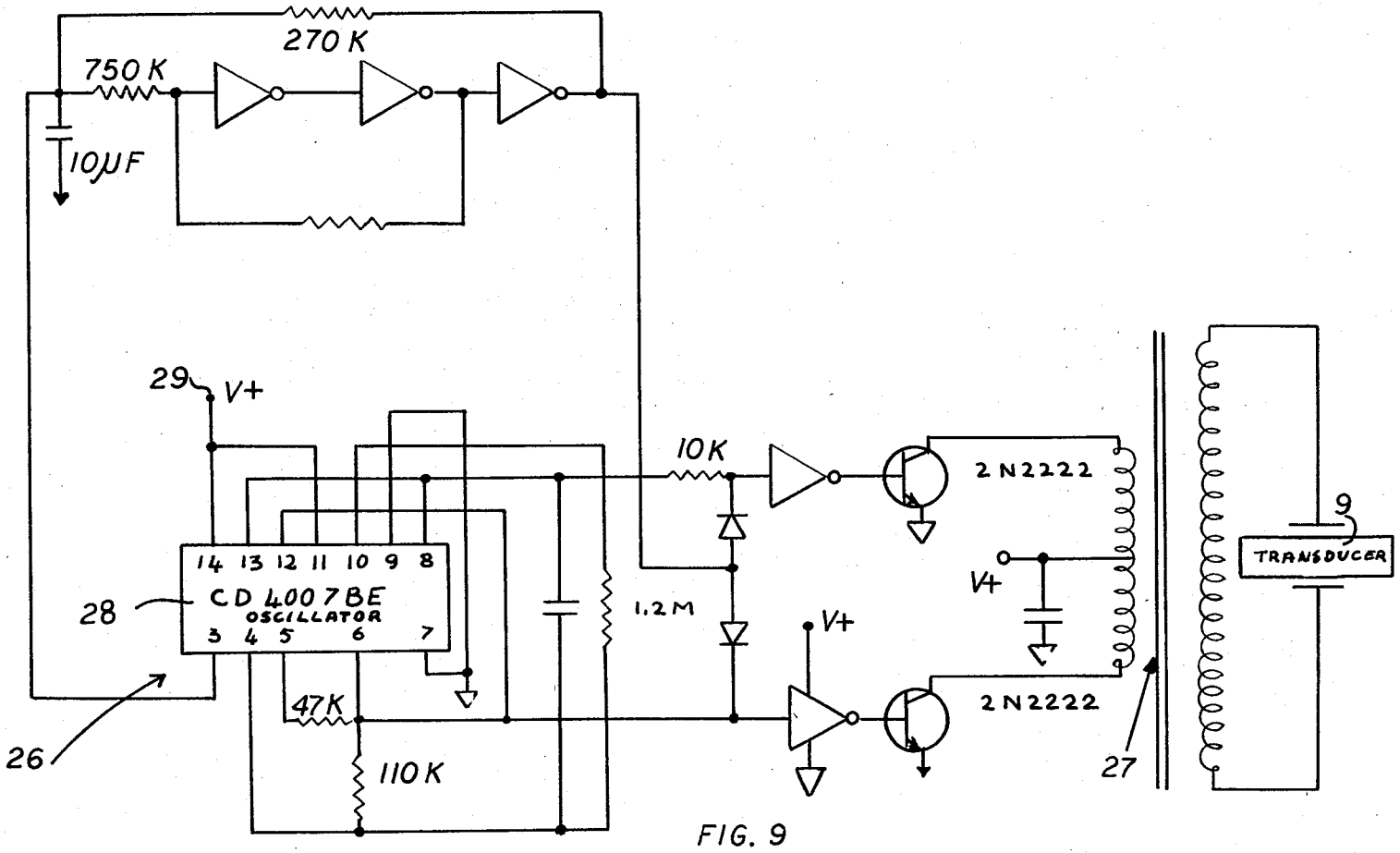
FIG. 9 is a circuit diagram showing the audio signalling circuit used in the ski alarm.

The audio signalling circuit 8 will now be described in more detail in connection with FIGS. 8 and 9. The circuit is mounted inside the housing 13 adjacent the recess 12, and the speaker or transducer 9 is mounted above the rest of the circuit in a recessed opening 25 in the housing.

The circuit basically comprises an oscillator circuit 26 for producing a square wave across the transducer 9 via pot core step up transformer 27 when connected to the batteries 10. The circuit 26 includes IC oscillator 28 having battery input connections 29. The batteries are connected by moving into contact with fixed contact 11 under the action of spring contact 12. Thus a sound signal will be emitted from the speaker 9 whenever the switch contacts 11 and 12 are in contact with the positive and negative ends of the batteries 10, connecting the batteries to the oscillator 28.

The entire alarm unit is designed to be very thin such that it can be located underneath the ski boot as shown in FIGS. 1 and 2. It may be bolted in place or secured with glue or double-sided adhesive tape. In fact the entire unit will be only about 0.80 cms thick. In the preferred embodiment, the width is about 6 cms and the length of the device is about 5 cms. The unit is preferably mounted about 0.3 cms in front of the heel binding, and will be either flush or recessed inwardly from the ski edges to permit them to be sharpened.

In the preferred embodiment, the electronic circuit components are all miniature and all except the transducer are mounted on a printed circuit board 29 (see FIG. 8) mounted in recesses in the housing. The batteries 10 are preferably lithium coil cell batteries which will operate at the low temperatures normal in snow conditions. The piezoelectric transducer speaker disc 9 is suitably of the order of 0.05 cms thick. In one specific example the input voltage from the batteries may be in the range from 3.2 to 6.0 volts, the IC oscillator is a CD4007 BE chip, the transducer is a Murata 7BB-35-3 and the transformer produces a 41 volt peak to peak square wave signal across the transducer. This results in an audio alarm signal sweeping from 1900 to 2300 Hz with an 8 second period. Clearly there are many alternative circuits for producing such a signal. Any sufficiently loud and distinctive audio alarm signal may be used.

Since the alarm unit is self-contained, compact, and small enough to be mounted on a ski so as to be located under a ski boot between the heel and toe bindings, it is protected from mechanical damage while ski-ing and can be easily installed by a skier as an accessory for his skis, without any modification being necessary to the bindings or ski boots. The electronic components are sealed in a housing which is preferably plastic. The contacts and batteries are sealed in a silicone rubber boot, which is an interference fit in the recess 12. Thus all the components are protected from moisture. The rubber boot can be pulled out of the recess to replace the batteries when necessary.

The unit can be latched off when not in use, and the latch is automatically released when a ski boot is installed on the ski. Thus the skier does not have to remember to re-actuate the alarm unit every time he skis.

Although the preferred embodiment of the invention has been described above by way of example, it will be clear that modifications can be made to the disclosed embodiment without departing from the scope of the invention, which is defined in the appended claims.

What is claimed is:

1. A ski tracking alarm for mounting on a ski between the toe and heel bindings and beneath a ski boot during ski-ing comprising:

an audible alarm device;

an actuating device consisting of a switch spring loaded towards a closed, operative position and urged into an open, inoperative position on mounting of a ski boot on the ski;

latching means for latching the actuating device in its inoperative position while the alarm is not in use; and release means for releasing the latching means on mounting of a ski boot on the ski.

2. The alarm of claim 1 further comprising:

a housing in which said alarm device is mounted, said housing having a recess in which said actuating device is mounted;

resilient seal means for sealing said actuating device in said recess; and a battery power supply controlled by said switch and located between a fixed switch contact and a movable switch contact of said switch.

3. A ski tracking alarm comprising:

a self-contained unit for mounting on a ski between the toe and heel bindings so that it is located beneath a ski boot during ski-ing, the unit comprising an audible alarm device and an actuating device for operating the alarm device to produce an audible signal on separation of the ski boot from the ski, the actuating device including spring loaded actuator means urged by pressure of the ski boot on the unit into an inoperative position and movable into an operative position when released by removal of the ski boot from the ski;

latching means for latching the actuating device in its inoperative position while the alarm is not in use; and wherein said latching means includes release means for releasing the latching means on mounting of a ski boot on the ski.

4. A ski tracking alarm comprising a selfcontained unit for mounting on a ski between the toe and heel bindings so that it is located beneath a ski boot during ski-ing, the unit comprising:

an audible alarm device and an actuating device for operating the alarm device to produce an audible signal on separation of the ski boot from the ski, the actuating device including spring loaded actuator means urge by pressure of the ski boot on the unit into an inoperative position and movable into an operative position when released by removal of the ski boot from the ski;

a housing in which said alarm device is mounted, said housing having a recess in which said actuating device is mounted, and resilient seal means for sealing said actuating device in said recess;

said actuating device comprising a power supply for operating said alarm device and said actuator means comprises switch means for controlling connection of said power supply to said alarm device; and wherein said power supply comprises battery means located between a fixed switch contact and a movable switch contact, said movable switch contact comprising a spring-loaded means for urging said battery means into contact with said fixed contact and said battery means being held in a position spaced from said fixed contact by pressure of a ski boot mounted on a ski, whereby said battery means is connected to said alarm device on removal of said ski boot.

5. The alarm as claimed in claim 4, including latch means mounted above said housing between said actuating device and said boot, said latch means including means for locking engagement with said housing to hold said actuating device in an inoperative position when said alarm is not in use.

6. The alarm as claimed in claim 5, wherein said latch means comprises means for bearing on said actuating device to hold said switch contacts open when said latch means is locked, and said locking means incorporating release means for automatically releasing said locking means on fitting of a ski boot on the ski.

7. The alarm as claimed in claim 6, wherein said latch means comprises a latch plate extending across the upper face of said housing and spring loaded away from said housing, said latch plate having a downwardly projecting locking tab and said housing having a recess for locking engagement with said tab, said tab being spring loaded out of said recess by downward pressure on said latch plate on fitting of a ski boot on the ski.

* * * * *